US010488032B2

(12) United States Patent
Duckworth et al.

(10) Patent No.: US 10,488,032 B2
(45) Date of Patent: Nov. 26, 2019

(54) AREA LUMINAIRE WITH HEAT FINS

(71) Applicant: Hubbell Incorporated, Shelton, CT (US)

(72) Inventors: Jason Edward Duckworth, Simpsonville, SC (US); Mark Vincent Elmore, Jr., Easley, SC (US); Douglas S. Hodges, Anderson, SC (US); Taylor A. Jenson, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 54 days.

(21) Appl. No.: 14/724,346

(22) Filed: May 28, 2015

(65) Prior Publication Data

US 2015/0345772 A1 Dec. 3, 2015

Related U.S. Application Data

(60) Provisional application No. 62/005,665, filed on May 30, 2014.

(51) Int. Cl.

| | |
|---|---|
| ***F21V 29/76*** | (2015.01) |
| ***F21S 8/08*** | (2006.01) |
| ***F21V 17/06*** | (2006.01) |
| ***F21V 23/00*** | (2015.01) |
| *F21W 131/103* | (2006.01) |

(52) U.S. Cl.

CPC ..... *F21V 29/76* (2015.01); *F21S 8/085* (2013.01); *F21V 17/06* (2013.01); *F21V 23/004* (2013.01); *F21V 23/009* (2013.01); *F21V 29/763* (2015.01); *F21W 2131/103* (2013.01)

(58) Field of Classification Search

CPC ..... F21V 29/76; F21V 29/763; F21S 8/085

See application file for complete search history.

(56) References Cited

U.S. PATENT DOCUMENTS

| | | | | |
|---|---|---|---|---|
| 9,261,251 | B1 * | 2/2016 | Ladewig | F21S 8/085 |
| 2009/0196054 | A1 * | 8/2009 | Cheng | F21V 15/01 362/373 |

(Continued)

FOREIGN PATENT DOCUMENTS

| | | | |
|---|---|---|---|
| CN | 201152495 | Y | 11/2008 |
| CN | 201363576 | Y | 12/2009 |

(Continued)

OTHER PUBLICATIONS

PCT/US2015/32960 International Search Report and Written Opinion dated Sep. 24, 2015.

(Continued)

*Primary Examiner* — Jong-Suk (James) Lee
*Assistant Examiner* — Christopher E Dunay
(74) *Attorney, Agent, or Firm* — Michael Best & Friedrich, LLP

(57) ABSTRACT

A luminaire includes a housing, a plurality of fins, and an LED module. The housing includes a first compartment having a top wall, a side wall extending from the top wall, and a first opening in the side wall. The plurality of fins is positioned in the first compartment so that at least one fin is in communication with the first opening. The LED module is connected to at least one of the heat fins and includes a PCB, a bezel, and at least one LED.

14 Claims, 10 Drawing Sheets

(56) References Cited

U.S. PATENT DOCUMENTS

2010/0265708 A1* 10/2010 Lin ..... F21V 29/004 362/249.02
2010/0290237 A1* 11/2010 Chien ..... F21V 29/004 362/373
2011/0032697 A1* 2/2011 Hu ..... F21S 8/086 362/190
2011/0063832 A1* 3/2011 Hu ..... F21V 29/74 362/235
2011/0222284 A1* 9/2011 Kong ..... F21S 8/086 362/249.02
2012/0008329 A1* 1/2012 Wang ..... F21V 15/01 362/372
2012/0262917 A1* 10/2012 Courcelle ..... F21V 15/01 362/235
2013/0003378 A1* 1/2013 Dube ..... F21S 8/086 362/249.03
2013/0088869 A1* 4/2013 Yun ..... F21V 29/004 362/249.01
2013/0235583 A1* 9/2013 Chang ..... F21V 7/0083 362/249.02
2013/0242574 A1* 9/2013 Guercio ..... F21V 23/008 362/373
2014/0049961 A1 2/2014 Wilcox et al.
2014/0146544 A1* 5/2014 Gebhard ..... F21V 5/04 362/311.02
2015/0184808 A1* 7/2015 Wang ..... F21K 9/30 362/235
2016/0186970 A1* 6/2016 Sorenson ..... F21S 8/086 362/234
2016/0305640 A1* 10/2016 Brown ..... F21V 29/673

FOREIGN PATENT DOCUMENTS

CN 201804508 U 4/2011
CN 201811032 U 4/2011
CN 102635792 8/2012
CN 202469878 U 10/2012
CN 202719580 U 2/2013
CN 203298245 U 11/2013

OTHER PUBLICATIONS

Chinese Patent Application No. 201580035519.6 First Office Action issued by the China National Intellectual Property Administration dated Oct. 18, 2018 and translation (18 pages).
Chinese Patent Application No. 201580035519.6 Second Office Action issued by the China National Intellectual Property Administration dated Mar. 26, 2019 and translation (19 pages).

* cited by examiner

AREA LUMINAIRE WITH HEAT FINS

CLAIM TO PRIORITY

This application is based on U.S. Provisional Application Ser. No. 62/005,665, filed May 30, 2014, the disclosure of which is incorporated herein by reference in its entirety and to which priority is claimed.

FIELD

Various exemplary embodiments relate to light fixtures or luminaires, for example external area light fixtures designed to illuminate streets, paths, parking lots, or other areas.

BACKGROUND

Light fixtures, or luminaires, are used with electric light sources to provide an aesthetic and functional housing in both interior and exterior applications. One type of light fixture is an area light, generally used for exterior lighting of roads, walkways, parks, parking lots, or other large areas requiring a significant amount of lighting. Area lights typically include a light fixture attached to a pole, wall, or other elevated structure to provide an elevated lighting position. In recent years, lighting applications, including area lights have trended towards the use of light emitting diodes (LEDs) as a light source in place of conventional incandescent and fluorescent lamps.

SUMMARY

According to an exemplary embodiment, a luminaire includes a housing, a plurality of fins, and an LED module. The housing includes a first compartment having a top wall, a side wall extending from the top wall, and a first opening in the side wall. The plurality of fins is positioned in the first compartment so that at least one fin is in communication with the first opening. The LED module is connected to at least one of the heat fins and includes a PCB, a bezel, and at least one LED.

According to another exemplary embodiment, a luminaire includes a housing, a plurality of fins, and an LED assembly. The housing includes a first compartment having an interior, a top wall, a side wall extending from the top wall, and an opening in the side wall. The plurality of fins is positioned in the interior of the housing. The plurality of fins has a plurality of bottom surfaces substantially planar with one another. The LED assembly is connected to at least one of the fins.

According to another exemplary embodiment, a luminaire includes a housing, a plurality of fins, and an LED module. The housing includes a first compartment having a top wall. A side wall extends from the top wall. The side wall has a first opening and the top wall has a second opening. A plurality of fins are positioned in the first compartment so that at least one fin is in communication with the first opening. An LED module is connected to at least one of the heat fins including a PCB, a bezel, and at least one LED.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
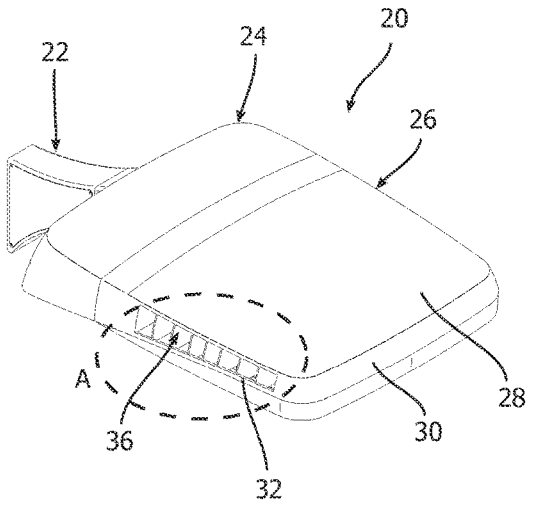
FIG. 1 is a top, front perspective view of a luminaire according to an exemplary embodiment.
Figure 2:
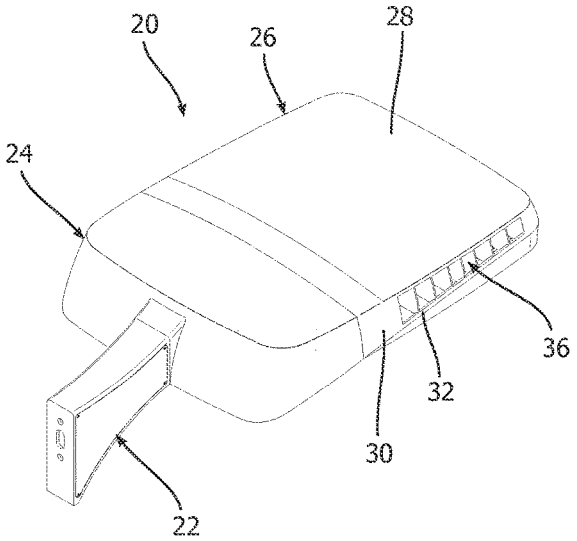
FIG. 2 is a top, rear perspective view of the luminaire of FIG. 1.
Figure 1A:
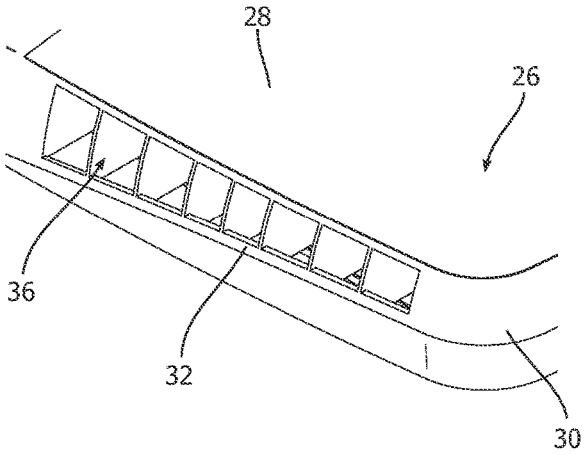
FIG. 1A is an enlarged view of section A of FIG. 1.

According to various exemplary embodiments, a luminaire includes a housing 20 having an arm 22, a first compartment 24, and a second compartment 26. The arm 22 connects the housing 20 to a wall, post, or other support or structure so that the luminaire can direct light to a given area. In an exemplary embodiment, the first compartment includes one or more electronic components and the second compartment includes one or more light sources. For example, the first compartment 24 houses one or more drivers (not shown) and other necessary equipment to supply power to light emitters contained in or otherwise connected to the second compartment 26. The second compartment 26 can be configured to contain a variety of light emitters in different patterns based on the desired use and light output. The positions of the first and second compartments 24, 26 may vary as needed.

In various exemplary embodiments the housing 20 is made from aluminum, although other metal, polymer, or composite materials may also be used. The housing 20 may be integrally formed or formed in separate sections and attached to one another. A lens, diffuser, or other cover (not shown) may be connected to the housing 20 positioned beneath the light emitters. The housing 20 can have various shapes, sizes, and configurations as needed.

According to various exemplary embodiments, the second compartment 26 includes a top wall 28, and a side wall 30 extending at least partially around the top wall 28 to define an interior. The top wall 28 is a substantially continuous structure, although different configurations may be used depending on the housing 20. In other exemplary embodiments different numbers of sidewalls can be used, including a continuous sidewall having a first side, a second side, and a front. The top wall 28 and the side wall 30 may be integrally formed or formed in separate sections and connected to one another. The side wall 30 includes a first opening 32 on a first side and a second opening 34 on a second side. In the illustrated exemplary embodiment, the first and second openings 32, 34 extend through the side wall 30 to the interior and have a substantially trapezoidal shape with sides that taper along the length of the second compartment 26. In alternative embodiments, the size, shape, and configuration of the first and second openings 32, 34 is varied depending on the housing, the light emitters, and the desired light output and performance of the luminaire.

As best shown in FIGS. 9-12, and in accordance with further exemplary embodiments, the interior of the second compartment 26 includes a plurality of fins 36 spaced from one another by gaps. One or more fins 36 extend down from a bottom surface of the top wall 28, extending from the first side to the second side of the side wall 30. In various exemplary embodiments, the fins 36 can extend from the front to back or diagonally across the housing 20. The fins 36 are at least partially exposed to the outside of the second compartment 26 on the bottom and one or more of the fins 36 can be in communication with the first and second openings 32, 34, for example in thermal and/or fluid communication. In an exemplary embodiment one or more of the fins 36 are exposed to the outside of the second compartment 26 on the sides through the openings 32, 34.

Figure 12:
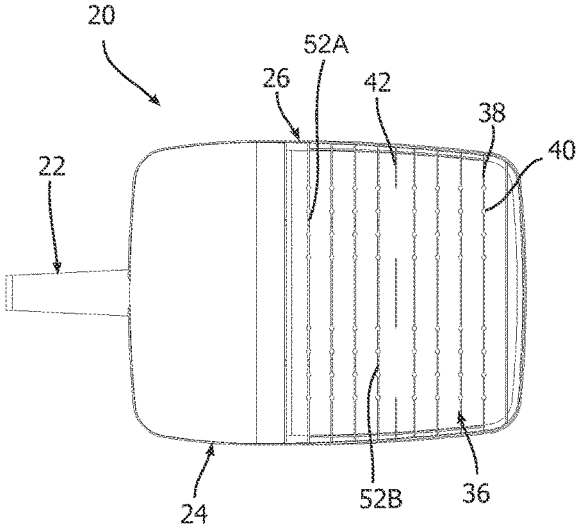
FIG. 12 is a bottom view of the luminaire of FIG. 11.
Figure 13:
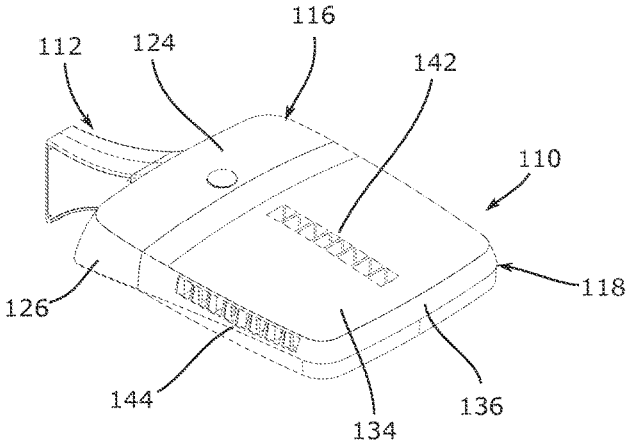
FIG. 13 is a top, front perspective view of another exemplary luminaire.
Figure 14:
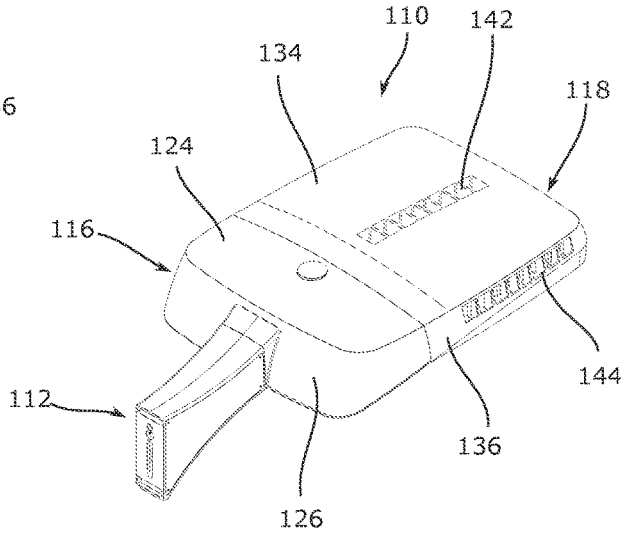
FIG. 14 is a top, rear perspective view of FIG. 13.
Figure 15:
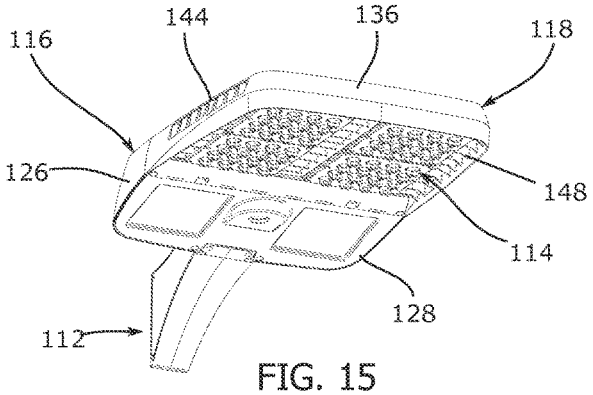
FIG. 15 is a bottom, front perspective view of FIG. 13.
Figure 16:
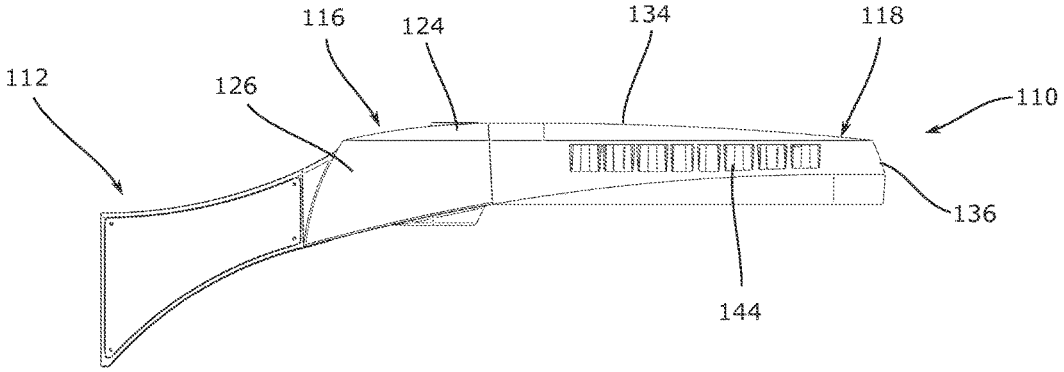
FIG. 16 is a left side view of FIG. 13.
Figure 17:
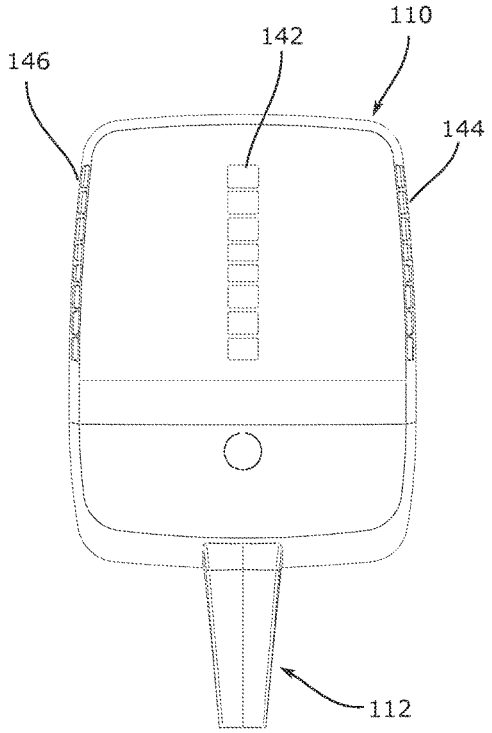
FIG. 17 is a top view of FIG. 13.
Figure 18:
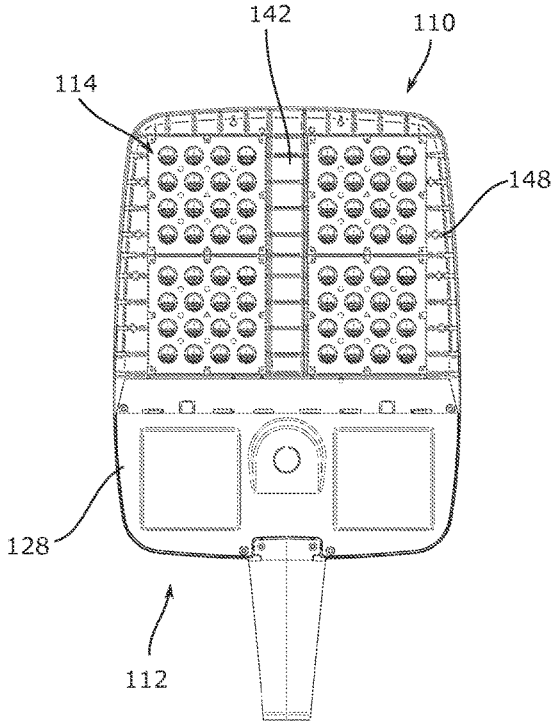
FIG. 18 is a bottom view of FIG. 13.
Figure 19:
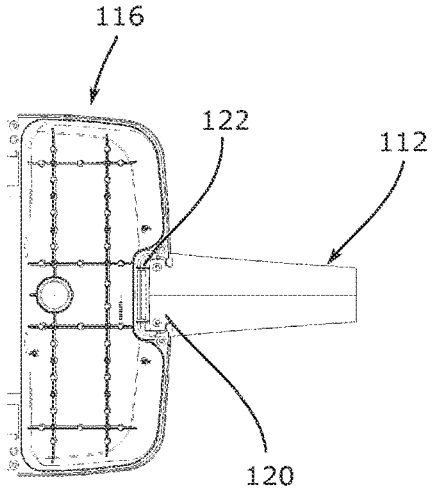
FIG. 19 is a bottom view of an exemplary arm and first compartment.
Figure 20:
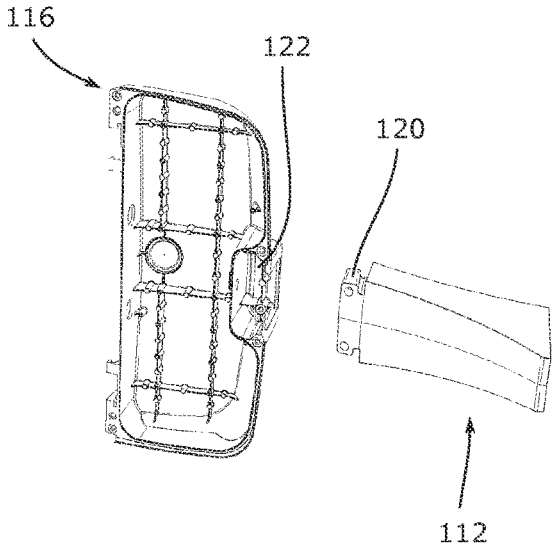
FIG. 20 is an exploded view of FIG. 19.
Figure 21:
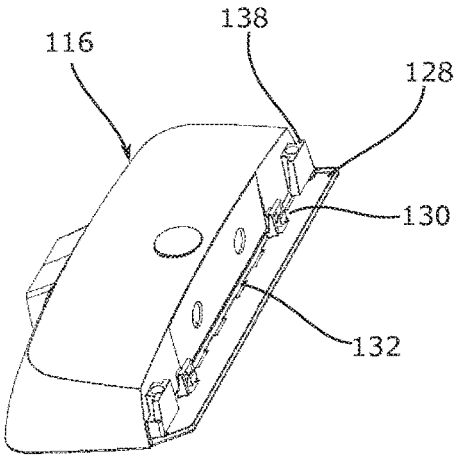
FIG. 21 is a top perspective view of the first compartment and an exemplary door.
Figure 22:
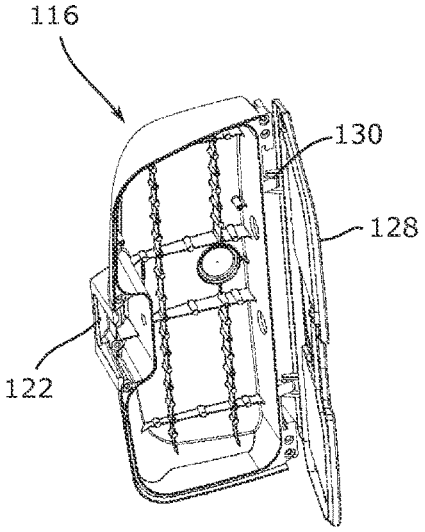
FIG. 22 is a bottom perspective view of FIG. 21 with the door in an open position.
Figure 23:
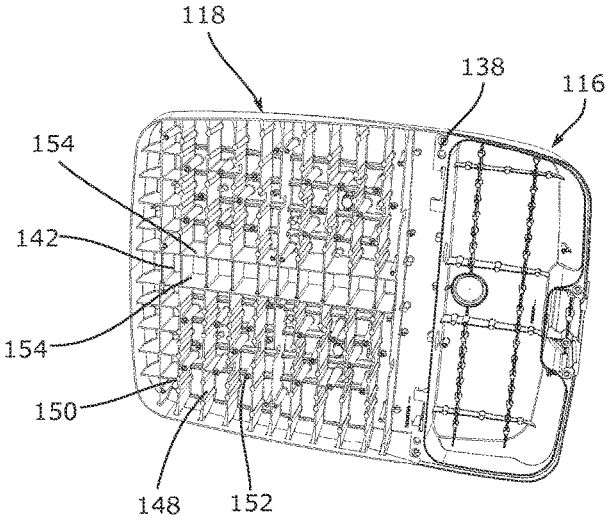
FIG. 23 is a bottom perspective view of the exemplary first and second compartments.
Figure 24:
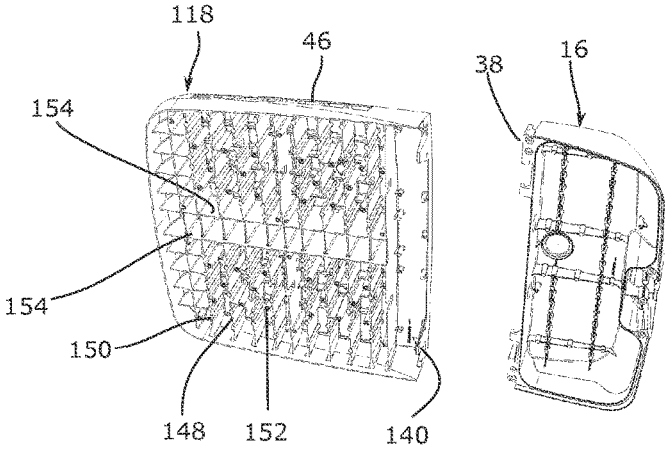
FIG. 24 is an exploded view of FIG. 23.
Figure 25:
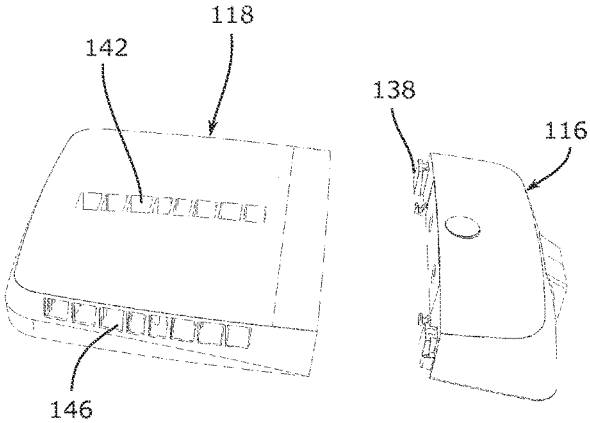
FIG. 25 is a top perspective view of FIG. 24.

In various exemplary embodiments, the fins 36 are connected to the bottom surface of the top wall 28, spaced from the bottom surface of the top wall 28, or any combination thereof. The bottoms of the fins 36 are substantially planar to one another so that the overall height of each fin 36 may vary according to the curve or taper of the second compartment 26. One or more fins 36 include at least one substantially planar portion 38 and at least one embossed or enlarged portion 40. According to an exemplary embodiment, one or more interval fins 42 does not include any embossed portion 40 and does not extend across the entire second compartment 26. The interval fin 42 can be configured similar to the other fins 36 as required. As best shown in FIG. 12, the interval fin 42 has a first, second, and third portion spaced by a first and second gap. The fins 36 are made from metal, for example aluminum. The fins 36 and the may be formed integrally with the second compartment 26 or formed separately and attached to the second compartment 26, for example through welding or fasteners. In various alternative embodiments, the size shape and configuration of the fins 36 can be varied depending on the housing and the required heat dissipation. The fins 36 may also be adapted to be used with different housings and types of luminaires.

As best shown in FIGS. 3, 6, and 9-10, and in accordance with further exemplary embodiments, the second compartment 26 contains one or more light emitters. In the exemplary embodiment shown, the light emitters are a plurality of light emitting diode (LED) modules 44. The luminaire may utilize other light sources, for example other solid state, electrical filament, fluorescent, plasma, or gas light sources. In an exemplary embodiment, the LED modules 44 include one or more LED light source connected to a printed circuit board (PCB) (not shown). The LED light sources can include a dome-shaped lens surrounding one or more light generating elements and necessary circuitry. Various types of LED modules may be used depending on the performance requirements and the desired output as would be understood by one of ordinary skill in the art.

Figure 3:
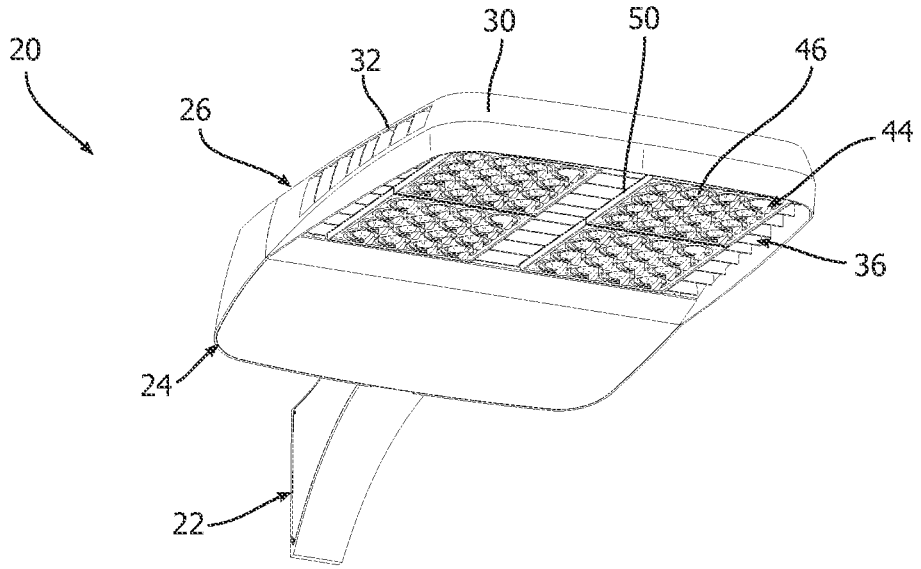
FIG. 3 is a bottom, front perspective view of the luminaire of FIG. 1.
Figure 4:
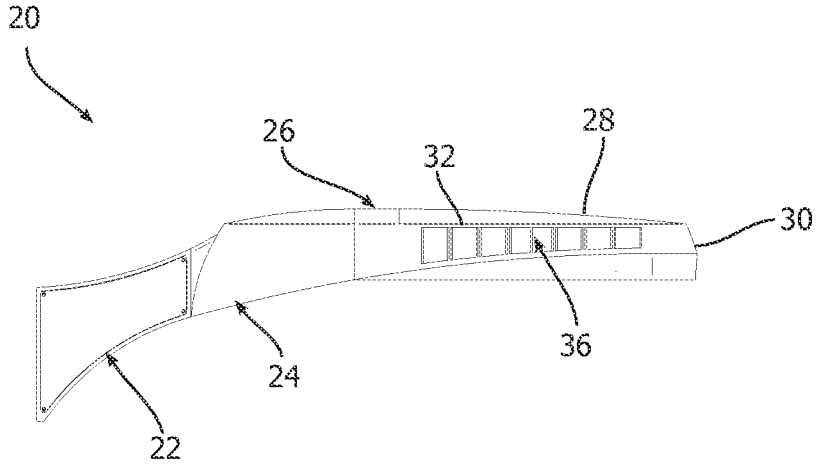
FIG. 4 is a side view of the luminaire of FIG. 1.
Figure 5:
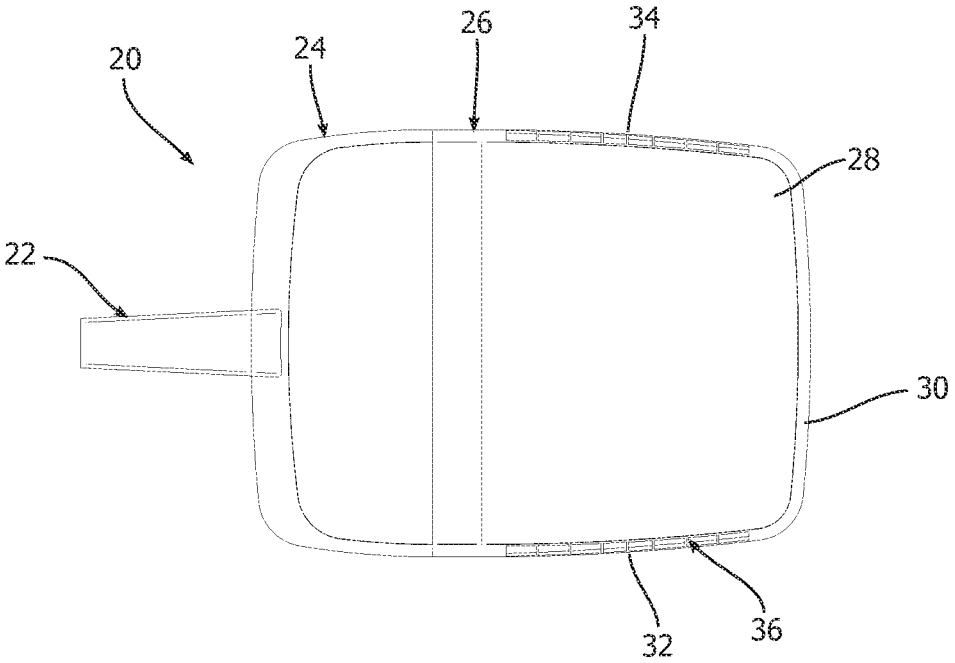
FIG. 5 is a top view of the luminaire of FIG. 1.
Figure 6:
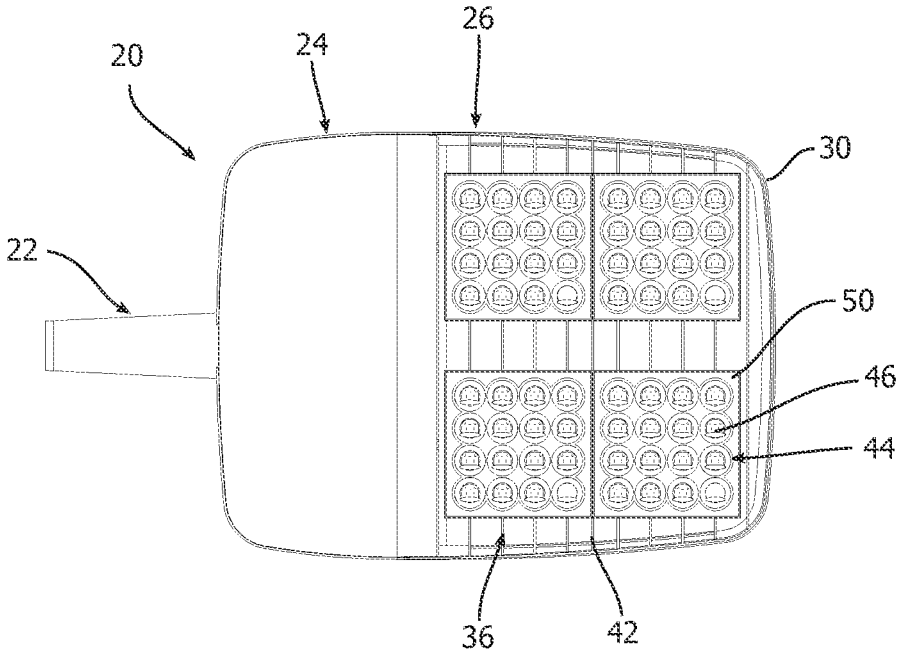
FIG. 6 is a bottom view of the luminaire of FIG. 1.
Figure 7:
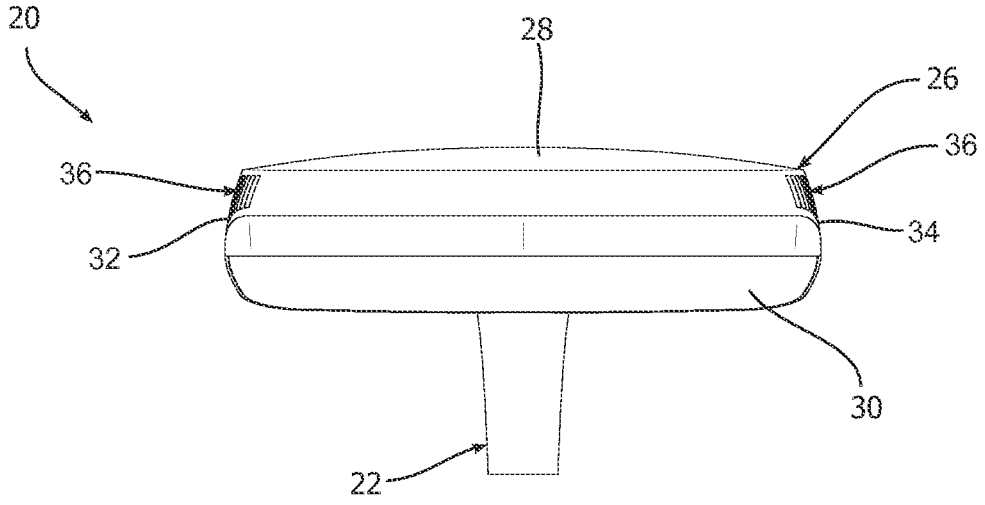
FIG. 7 is a front view of the luminaire of FIG. 1.
Figure 8:
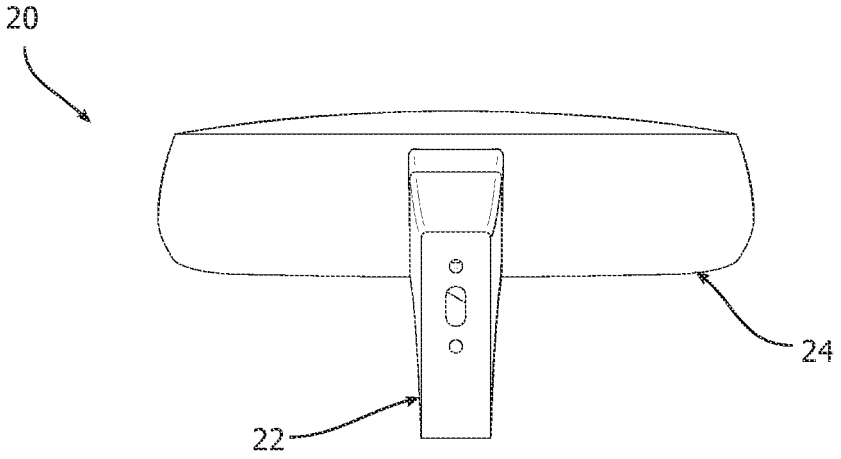
FIG. 8 is a rear view of the luminaire of FIG. 1.

According to an exemplary embodiment, an optic 46 is positioned over each LED light source to direct or diffuse the emitted light. The optic 46 may be moveable, for example rotatable and angled, with respect to the PCB. Groups of LED modules 44 can be used, for example the front and rear right modules and front and rear left modules—as shown in FIGS. 3 and 5. The LED modules 44 may be arranged in different groupings and patterns depending on the housing 20 and the desired light output.

Figure 9:
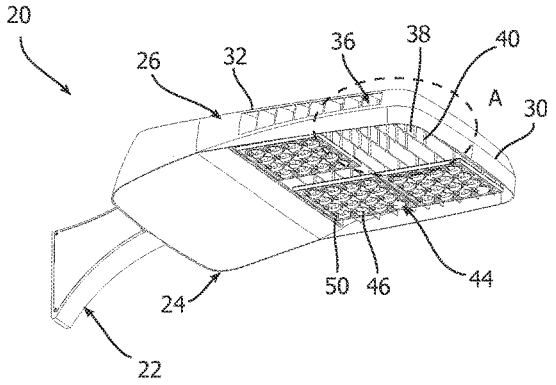
FIG. 9 is a bottom view of the luminaire of FIG. 1 with an LED module removed.
Figure 10:
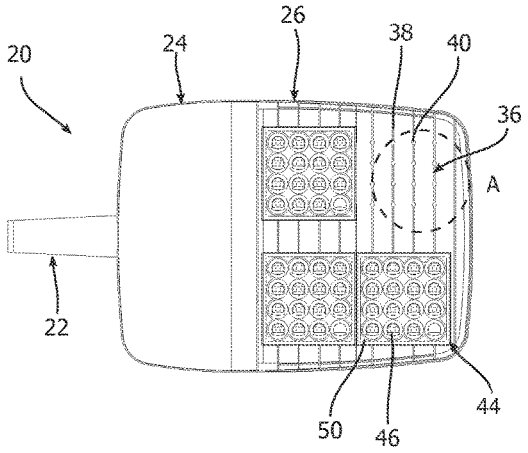
FIG. 10 is a bottom view of the luminaire of FIG. 9.
Figure 10A:
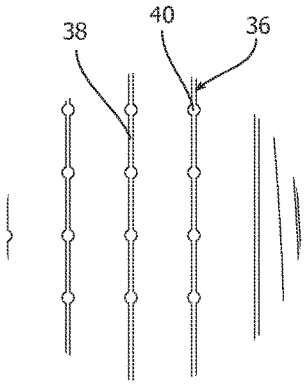
FIG. 10A is an enlarged view of section A of FIG. 10.

The LED modules 44 are connected to a power source, such as a driver housed in the first compartment 24. The PCB includes traces or pathways to provide power to the LEDs. A backing member or bezel 50, for example a sheet metal backing layer or enclosure at least partially encloses and at least partially isolates the PCB in the second compartment 26. As best shown in FIGS. 9-10, and according to various exemplary embodiments, the bezel 50 covers the top, sides, and bottom of the PCB and has openings to allow the optics 46 to extend through the bezel 50. The bezel 50 may be configured to seal the perimeter of the PCB. The various sizes and shapes of the PCB, as well as the various light sources, materials, and other configurations used in connection with the PCB, would be understood by one of ordinary skill in the art.

Figure 9A:
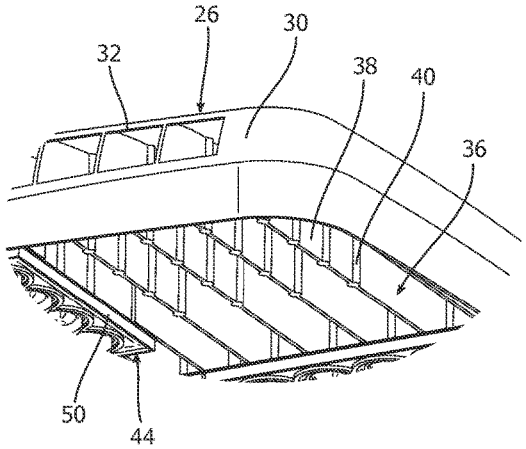
FIG. 9A is an enlarged view of section A of FIG. 9.

According to various exemplary embodiments, the LED modules 44 are connected to the bottom surface of the fins 36, to the top or sides of the second compartment 26, or any combination thereof. The LED modules 44 are connect to the fins 36 or second compartment 26 by mechanical fasteners, for example mounting screws or bolts, or other available mechanical or chemical connections. In an exemplary embodiment where the bottom surfaces of the fins 36 are substantially planar, the LED modules 44 extend substantially planar to one another, for example in a horizontal plane substantially parallel to the ground, although the LED modules 44 can also be obliquely angled to the ground. As best shown in FIGS. 9 and 9A, and according to various exemplary embodiments, the LED modules 44 are spaced so that at least a portion of the fins 36 are exposed on the bottom. The fins 36 are designed to dissipate heat from the LEDs and the configuration of the second compartment 26, fins 36, and LED modules 44 allows air to flow underneath of the housing 20, through the interior, and through the first and second openings 32, 34.

According to an exemplary embodiment, an embossed portion 40 of the fins 36 extends substantially over each LED package and the interval fin 42 is positioned along the intersection of the front and rear LED modules 44. The embossed portion 40 creates a larger surface area that allows heat to be more efficiently dissipated from the LEDs.

Figure 11:
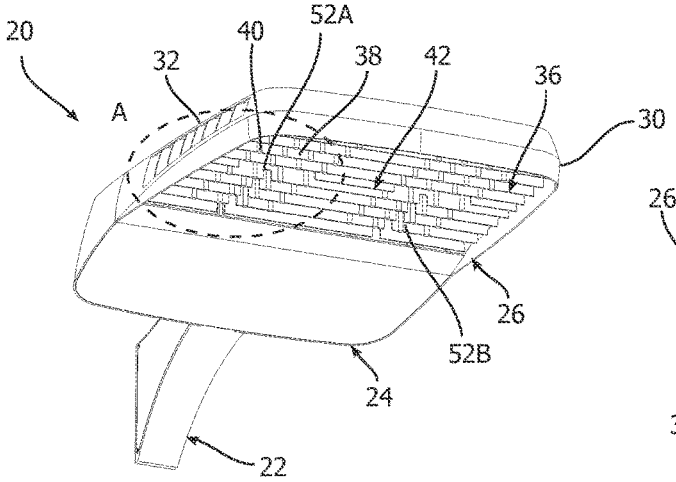
FIG. 11 is a bottom perspective view of the luminaire of FIG. 1 with all of the LED modules removed.
Figure 11A:
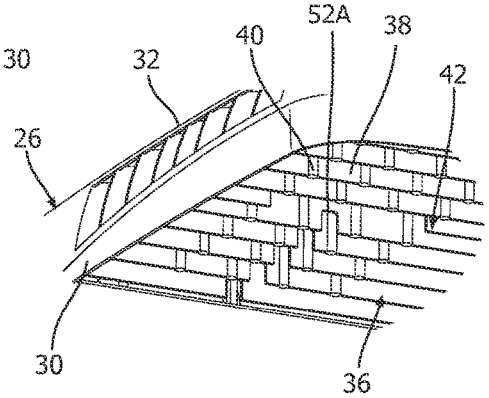
FIG. 11A is an enlarged view of section A of FIG. 11.

According to various exemplary embodiments, one or more drivers connect to the one or more LED modules 44. For example, a single driver may power the four LED modules 44 shown in FIGS. 3 and 5 or separate drivers may power each LED module 44. As best shown in FIGS. 11-12, and according to an exemplary embodiment, one or more of the fins 36 includes one or more channels, for example a first channel 52A and a second channel 52B to act as a conductor path. The first channel 52A provides a path to the left side LED modules 44 and second channel 52B provides a path to the right side LED modules 44. The interval fin 42 may also include one or more gaps or channels to allow conductors to pass to the front LED module 44. In alternative embodiments, spacing may be provided between the top of the PCB and the bezel 50 to allow conductors to pass from the conductor compartments to the LED modules 44 or openings may be included through the heat fins 36.

FIGS. 12-25 show another exemplary luminaire that includes a housing 110, an arm 112, and one or more light emitter assemblies connected to the housing. The housing includes a first compartment 116 and a second compartment 118. The arm 112 connects the housing no to a wall, post, or other support or structure so that the luminaire can direct light to a given area. In an exemplary embodiment, the first compartment 116 includes one or more electronic components and the second compartment includes one or more light sources. For example, the first compartment 116 houses one or more drivers (not shown) and other necessary equipment to supply power to light emitters 114 contained in or otherwise connected to the second compartment 118. The second compartment 118 can be configured to contain a variety of light emitters in different patterns based on the desired use and light output. The positions of the first and second compartments 116, 118 may vary as needed.

In various exemplary embodiments the housing no is made from aluminum, although other metal, polymer, or composite materials may also be used. The housing 10 may be integrally formed or formed in separate sections and attached to one another. A lens, diffuser, or other cover (not shown) may be connected to the housing positioned beneath the light emitters. The housing can have various shapes, sizes, and configurations as needed.

In an exemplary embodiment, the arm 112 is removably connected to the housing 110. The arm 112 includes a first mounting component 120 that engages with a second mounting component 122 on the housing. The arm 112 is initially connected to a structure, for example by one or more fasteners. The housing no is then connected to the arm 112, eliminating the need to hold and manipulate the entire luminaire housing during connection. In an exemplary embodiment, the arm 112 includes a projection that mates with a slot in the housing 10, so that the housing no can be slidably engaged with the arm 112. The housing no can then be furthered secured with fasteners. Other mounting connections can be used. The arm 112 can also include a removable panel that allows a user access to the interior of the arm, for example to access wiring.

The first compartment 116 includes a top wall 124, a side wall 126 extending at least partially around the top wall 124, and a door 128. One or more fins can extend from the top wall 124 to transfer heat from the electronic components. A sensor, for example a photo controller, extends through the top wall 124. The door 128 is removeably connected to the housing 110, for example with fasteners, to provide access to the first compartment 116. The door 128 can also be pivotally connected to the first compartment 116 through a hinge member 130. The door includes a recess that can optionally receive a sensor, for example an occupancy sensor or a camera. One or more gaskets can be used to seal a portion of the first compartment 116. A series of openings 130 can be provided, for example in the door 128, to allow fluid to pass through the housing 110.

The second compartment 118 includes a top wall 134, and a side wall 136 extending at least partially around the top wall 134 to define an interior. The top wall 134 is a substantially continuous structure, although different configurations may be used depending on the housing 110. In other exemplary embodiments different numbers of side walls 136 can be used, including a continuous side wall having a first side, a second side, and a front.

The first compartment 116 is connected to the second compartment 118, for example through corresponding first and second mounting features 138, 140. The first mounting feature 138 can extend from the first compartment 116 and the second mounting feature 140 can be positioned on the second compartment 118.

A top opening 142 extends through the top wall 124. The top opening 142 has a substantially rectangular shape. The side wall 136 includes a first opening 144 on a first side and a second opening 146 on a second side. In the exemplary embodiment, the first and second openings 44, 46 extend through the side wall 136 to the interior and have a substantially rectangular shape. In alternative embodiments, the size, shape, and configuration of the top, first, and second openings 142, 144, 146 is varied depending on the housing 110, the light emitters, and the desired light output and performance of the luminaire.

In accordance with further exemplary embodiments, the interior of the second compartment includes a plurality of fins 148 spaced from one another by gaps. One or more fins 148 extend down from a bottom surface of the top wall 134, extending from the first side to the second side of the side wall 136. In various exemplary embodiments, the fins 148 can extend from the front to back or diagonally across the housing 110. The fins 148 are at least partially exposed to the outside of the second compartment 118 on the bottom and one or more of the fins 148 can be in communication with the top, first and second openings 142, 144, 146, for example in thermal and/or fluid communication. In an exemplary embodiment one or more of the fins 148 are exposed to the outside of the second compartment 118 on the top and the sides through the openings.

In various exemplary embodiments, the fins 148 are connected to the bottom surface of the top wall 134, spaced from the bottom surface of the top wall 134, or any combination thereof. One or more fins 148 include an embossed or enlarged portion 150. The fins 148 may be formed integrally with the second compartment 118 or formed separately and attached to the second compartment 118, for example through welding or fasteners. In various alternative embodiments, the size shape and configuration of the fins 148 can be varied depending on the housing 110 and the required heat dissipation. The fins 148 may also be adapted to be used with different housings and types of luminaires.

The second compartment 118 contains one or more light emitters. In the exemplary embodiment shown, the light emitters are a plurality of light emitting diode (LED) modules 114. The luminaire may utilize other light sources, for example other solid state, electrical filament, fluorescent, plasma, or gas light sources. In an exemplary embodiment, the LED modules 114 include an LED board (not shown) having one or more LED light sources connected to a printed circuit board (PCB). The LED light sources can include a dome-shaped lens surrounding one or more light generating elements and necessary circuitry. Various types of LED modules 114 may be used depending on the performance requirements and the desired output as would be understood by one of ordinary skill in the art. According to an exemplary embodiment, an optic is positioned over each LED light source to direct or diffuse the emitted light. The optic extends through a bezel, for example a sheet metal enclosure at least partially encloses the LED board. According to an exemplary embodiment, the bezel covers the bottom and sides of the LED board and has openings for the optics. The bezel can also cover the top of the LED board if required. The bezel also may be configured to seal the perimeter of the LED board. In certain exemplary embodiments, the bezel and the optics are sealed together, for example through adhesives or welding, such as ultrasonic welding, to form an integral unit. The various sizes and shapes of the PCB, as well as the various light sources, materials, and other configurations used in connection with the PCB, would be understood by one of ordinary skill in the art.

More than one LED modules 114 can be used, for example front and rear right modules and front and rear left modules. The LED modules 114 may be arranged in different groupings and patterns depending on the housing and the desired light output. The LED modules 114 can be designed to emit light in a certain direction. For example, the optics can include light directing features that focus light in a uniform direction, for example toward the front of the housing. To modify the light output, the light modules can be removed and rotated so that the optics direct the light in a new direction. The exemplary, substantially square LED modules 114 shown can be adjusted ninety degrees at a time. Different shapes and configurations of LED modules 114 can allow for different rotation angles, for example a hexagonal LED module could be rotated sixty degrees.

According to various exemplary embodiments, the LED modules 114 are connected to the bottom surface of the fins 148, to the top or sides of the second compartment 118, or any combination thereof. The LED modules 114 are connected to the fins 148 or second compartment by mechanical fasteners, for example mounting screws or bolts, or other available mechanical or chemical connections. In an exemplary embodiment, one or more bosses 152 extend from the top wall and receive fasteners to connect the LED modules 114. According to various exemplary embodiments, the LED modules 114 are spaced so that at least a portion of the fins are exposed on the bottom. The fins are designed to dissipate heat from the LEDs and the configuration of the second compartment, fins, and LED modules 114 allows air to flow underneath of the housing 120, through the interior, and through the top, first, and second openings. In an exemplary embodiment, boundary walls 154 are positioned between the LED modules 114 and the top openings. The boundary wall 154 helps separate the LED modules 114 from the openings and provide protection from elements such as dirt or other debris and water. The boundary wall 154 can extend all the way to the top wall 134, or a top edge of the boundary wall 154 can be spaced from the top wall 134 to increased airflow around the LED modules 114. The exact height of the boundary wall 154 can be varied depending on the application.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a housing including a first compartment having a top wall, a side wall extending from the top wall, and a first opening in the side wall;

a plurality of fins positioned in the first compartment directly connected to and extending from the top wall with at least one fin-extending through the first opening and having an outer edge substantially aligned with a surface of the side wall; and an LED module directly connected to at least one of the heat fins opposite the top wall, the LED module including a PCB, a bezel, and at least one LED, wherein the fins are configured to dissipate heat from the LEDs such that the configuration of the housing, fins, and LED modules allows air to flow underneath of the housing, through the interior, and through the first opening.

2. The luminaire of claim 1, wherein the housing further comprises a driver compartment housing a driver, wherein the driver compartment is separated from the first compartment by a wall.

3. The luminaire of claim 1, wherein the housing and the plurality of fins are integrally formed.

4. The luminaire of claim 1, wherein the first compartment further comprises a second opening opposite the first opening.

5. The luminaire of claim 1, wherein at least one heat fin is exposed to an external environment through the bottom of the housing.

6. The luminaire of claim 1, wherein the LED module is removable from at least one of the heat fins.

7. A luminaire comprising:

a housing including a first compartment having an interior, a top wall, a side wall extending from the top wall, and an opening in the side wall;

a plurality of cantilevered fins positioned in the interior, the plurality of cantilevered fins having a plurality of fixed ends and a plurality of bottom surfaces opposite the fixed ends, the bottom surfaces substantially planar with and spaced from one another; and an LED assembly directly connected to the bottom surface of at least one of the fins, wherein the fins are configured to dissipate heat from the LEDs such that the configuration of the housing, fins, and LED modules allows air to flow underneath of the housing, through the interior, and through the first opening.

8. The luminaire of claim 7, further comprising at least two LED assemblies connected to the plurality of heat fins in a plane substantially parallel to a horizontal ground plane.

9. The luminaire of claim 7, wherein the LED assembly comprises a PCB, a bezel, an optic, and an LED.

10. The luminaire of claim 7, wherein
the fins extend from a first side of the interior to a second side of the interior.

11. The luminaire of claim 7, wherein
at least one of the fins is exposed through the opening and from a bottom of the housing.

12. The luminaire of claim 7, wherein
at least one of the fins includes an enlarged portion extending from the bottom surface and aligned with a light emitting device.

13. The luminaire of claim 7, wherein
at least one of the plurality of fins includes a channel defined therein.

14. The luminaire of claim 7, wherein the LED assembly is removable from at least one of the heat fins.

* * * * *